United States Patent [19]

Keller

[11] 4,426,954

[45] Jan. 24, 1984

[54] APPLICATING DIE DEVICE

[75] Inventor: Ronald E. Keller, Celina, Ohio

[73] Assignee: Indiana Wire Die Company, Inc., Fort Wayne, Ind.

[21] Appl. No.: 423,718

[22] Filed: Sep. 27, 1982

[51] Int. Cl.[3] ..... B05C 11/02

[52] U.S. Cl. ..... 118/125; 118/405; 118/DIG. 18

[58] Field of Search ..... 118/125, 404, 405, DIG. 18

[56] References Cited

U.S. PATENT DOCUMENTS

| | | | |
|---|---|---|---|
| 1,551,751 | 9/1925 | Kozak | 118/125 |
| 3,110,625 | 11/1963 | Bettner | 118/125 |
| 4,046,103 | 9/1977 | Yakuboff | 118/125 X |
| 4,281,617 | 8/1981 | Bevers et al. | 118/125 X |

*Primary Examiner*—John P. McIntosh
*Attorney, Agent, or Firm*—George A. Gust

[57] ABSTRACT

An applicating-device for use in coating a strand comprising a die assembly of two elements having contiguous flat surfaces which are securely laminated together, this die assembly having a bore through both elements which is of essentially uniform diameter through one of the elements and tapered through the other. The one element is of polycrystalline synthetic diamond material and the other element is of carbide material. The other surface of the polycrystalline element is flat and parallel to the aforesaid contiguous flat surfaces. The assembly is in two semi-circular halves which are abuttingly engaged along a plane which diametrically divides said bore. The method comprises cutting a laminated disc into halves along a diameter thereof, this disc being of two laminations, one of these being of polycrystalline diamond material and the other of carbide material. The two halves are assembled into a disc assembly and a coaxial bore is formed therethrough. The bore is of uniform diameter through said one lamination and is tapered in the other. The tapered portion is formed by grinding, and the surface of the bore portion in the polycrystalline lamination is polished to remove any roughness. Lastly, a radius is ground in the bore in the annular region where the uniform and tapered portions join thereby to avoid sharp corners.

4 Claims, 8 Drawing Figures

APPLICATING DIE DEVICE

BACKGROUND OF THE INVENTION

1. Field of the Invention

The present invention relates to a die device for applying a coating of fluent material to a strand, such as a length of wire, and more particularly to an applicating-die device formed in part of polycrystalline synthetic diamond material.

2. Description of the Prior Art

Strand material, such as wire, is conventionally coated with fluent materials in the form of adhesives or insulators, it being a primary objective to obtain a coating which is of uniform thickness and consistency. In the prior art, apparatus has been used which sprays material on moving conductors, rollers to apply a coating from a bath to a conductor which is advanced thereover at a tangent point of engagement, and dies having orifices have been used, the wire being coated with the fluent material prior to passing to the die, to wipe off excess material and to ensure a uniform coating. Typical of the die-type applicators are those found in U.S. Pat. Nos. 1,551,751; 4,046,103 and 4,281,671. In all three of these patents, the bore is formed in a natural, unsplit diamond suitably mounted in a holder. Since the bore portions of the dies are unsplit, the wire to be coated has to be threaded therethrough, and if a wire has already been thread through a machine, in order to insert the wire into the die, it is necessary to cut it so that it can be inserted. With reference to those die devices having other than flat exit surfaces, coating material collects thereon, eventually hardens and then produces unevenness in the coating as the wire emerges from the die.

Other die devices have been formed from brass in two diametral halves, the two halves being assembled into a cylindrical body through which a coaxial bore is formed. One portion of the bore is of uniform diameter and the other portion tapered, the body being formed with a curvilinear surface on the exit side of the bore. Such dies have been found to perform satisfactorily, but in production they have a relatively short wear life, such as a week. Making the same die of ceramic from a single piece of material results in longer wear life, a period of about nine to ten weeks production use having been experienced.

SUMMARY OF THE INVENTION

The present invention has an unexpectedly longer wear life many times that of the brass and ceramic dies just described and furthermore is not burdened with the problems relating to the die devices otherwise described in the foregoing. In particular, this invention includes an applicating device for use in coating a strand with a fluent material, this device comprising a die assembly of two elements having contiguous flat surfaces securely joined together. The die assembly is provided with a bore through both elements which is of essentially uniform diameter through one of the elements and tapered through the other. The one element is of polycrystalline synthetic diamond material and the other is of carbide material. The other surface of the polycrystalline element is also flat and oriented parallel to the aforesaid contiguous flat surfaces. The assembly is in two semi-circular halves which are abuttingly engaged along a plane which diametrically divides the bore.

The method relates to fabricating an applicating device as described hereinabove, this method comprising the steps of cutting a laminated disc into semi-circular halves, the disc being of two laminations, one lamination being of polycrystalline synthetic diamond material and the other being a carbide material. The two halves are assembled together into a disc assembly and a coaxial bore is formed through the disc assembly. This bore is made of uniform diameter through the polycrystalline lamination and is tapered in the carbide lamination. The tapered portion is formed by grinding, and the surface of the uniform diameter bore portion is polished. A radius is ground in the annular portion of the bore where the uniform and tapered portions join thereby to avoid sharp corners.

It is an object of this invention to provide an improved die device having greater wear life for production use and also a method for fabricating such a device.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
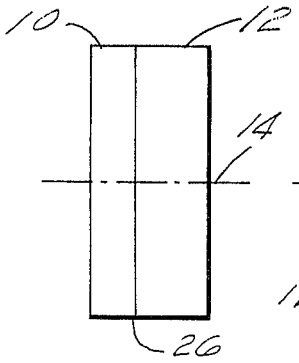
FIG. 1 is an edge view of a laminated disc from which the applicating die of this invention is fabricated.
Figure 2:
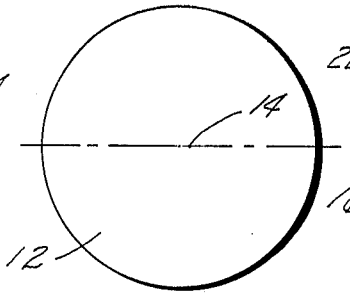
FIG. 2 is a front view thereof.

Referring to the drawings, and more particularly to FIGS. 1 through 4, the die device of this invention is formed of a laminated or layered disc, sometimes referred to as a tool blank, as shown in FIGS. 1 and 2, there being two disc-shaped laminations 10 and 12, lamination 10 being of a polycrystalline synthetic diamond material and the lamination 12 being of a carbide material. The opposite surfaces of both laminations are flat and parallel. The polycrystalline synthetic diamond material is commercially available under various designation, such as "Compax" manufactured by the General Electric Company U.S.A., and "Syndite" manufactured by De Beers Industrial Diamond Division. The aggregate of synthetic diamond is usually attached to a cemented carbide substrate of flat or annular form. In the present instance, the substrate is in the form of a flat disc. The lamination 10 is a similar disc in the form of an aggregate of synthetic diamond material.

More specifically, the blank 10, 12 used in a working embodiment of the present invention is manufactured by the General Electric Company and has part No. 1330 (disc). Also usable are disc halves having part No. 1325.

Assuming that the solid disc-shaped blank is used, the first step is to cut it in half along a diameter indicated by the numeral 14. The resulting semi-circular halves are then reassembled into disc form and while so held, a hole is coaxially drilled therethrough, by means of conventional techniques, such as laser drilling, resulting in a uniform diameter bore 16. This bore portion 16 is limited primarily to the polycrystalline lamination 10 as shown.

In the carbide lamination 12, the hole is formed with a taper indicated by the numeral 18, this taper being typically ground by the use of diamond powder and the like. The bore and taper portions 16 and 18 which are symmetrically and coaxially joined as shown are further bored and polished to size using a diamond powder slurry or the like. A very fine powder is used for final polishing in order to remove any semblance of roughness which might cause non-uniform application of fluent coating to a strand such as glass fiber or wire or the like drawn therethrough.

Lastly, the annular region 20 where the bore and tapered portions 16, 18 join is smoothly radiused (in axial section) thereby to avoid any sharp corners which could interfere with the uniform application of the coating on the strand. In other words, the two portions 16, 18 smoothly blend together without any sharp corners therebetween.

A typical diameter for the finished bore 16 is 0.064 inch that for the largest diameter portion of the taper 18 is 0.250 inch. The outside diameter of the disc 10, 12 is typically 0.325 inch. The thickness of lamination 10 is 0.020 inch, and of lamination 12 is 0.105 inch.

Of importance is the fact that the surface 22 on the exit side of the bore 16 is flat, lying in a plane normal to the axis of the bore 16 and taper 18. Also, the opposite side or surface of the die is indicated by the numeral 24 is also flat, these surfaces 22 and 24 being parallel to each other as well as to the interfaces 26 of the two laminations 10 and 12.

A small, coaxial, annular mounting groove 28 is provided in the outer periphery of the lamination 12 as shown.

Figure 5:
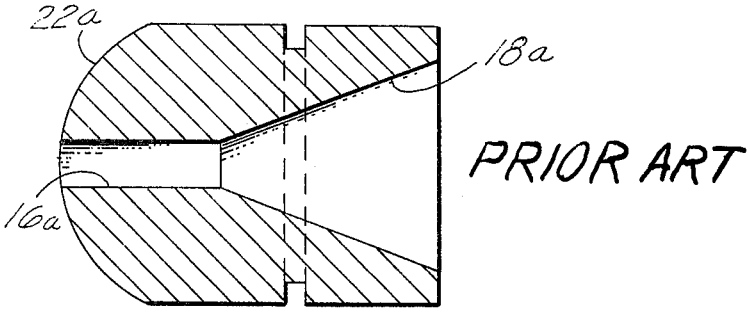
FIG. 5 is a similar diametral cross section of a prior art device.

A similar die device exists in the prior art as shown in FIG. 5, this device being cylindrical and in split halves with straight bore and tapered portions **16*a* and 18*a*, respectively. On the exit side of the bore 16*a*, the surface 22*a*** is curvilinear of necessity, as explained later.

Figure 4:
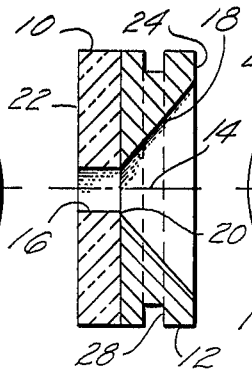
FIG. 4 is a diametral cross section thereof.
Figure 3:
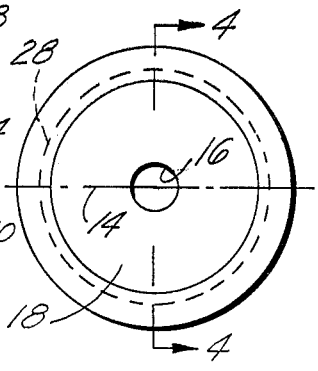
FIG. 3 is a front view of a die device of this invention.
Figure 7:
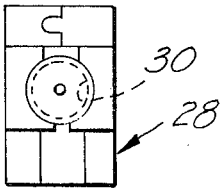
FIG. 7 is a top view thereof.
Figure 8:
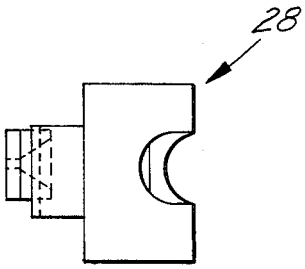
FIG. 8 is a side view.
Figure 6:
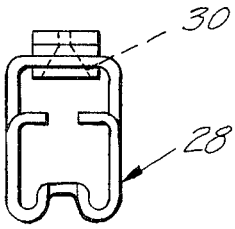
FIG. 6 is an end view of a die device of this invention mounted in a conventional holder.

Referring to FIGS. 6 through 8, the die device of FIGS. 3 and 4 is shown mounted in a conventional holder, this holder being indicated generally by the numeral 28 and being formed as a sheet metal stamping. The stamping is provided with an opening 30 of size to fit snuggly into the annular groove 28. The carbide layer 12 is then soldered to the holder 28 for securing it into position.

The holder and die device is mounted in a coating machine according to conventional practice, the strand being threaded through the bore and taper 16, 18. The strand is coated with a suitable, fluent material prior to entering the taper 18, the bore portion 16 wiping off the excess as the strand is drawn continuously at uniform speed therethrough. Of importance is the fact that the thickness of the layer of coating on the strand is controlled by the die device, particularly the size of the orifice as well as its smoothness.

With reference to the die device of FIG. 5, it has been found in practice that it is necessary to provide a curvilinear exit surface **22*a*, because if it is shaped otherwise, such as flat, fluent material collects thereon, hardens and then degrades the applied coating as provided by the bore 16*a*** such that no longer can a uniform coating be applied to the strand without first removing the accumulation.

In the present invention, it has been found that the flat surface 22 on the polycrystalline element 10 results in no deleterious collection which otherwise could interfere with the uniform application of the coating. It has been found in actual practice that this die device not only has a wear life many times greater than that of the prior art device of FIG. 5 or one like FIG. 5 made of ceramic, but there is no particular problem due to the collection of any solidified material on the surface 22. Applicant is unable to explain the reason why no material collects on the surface 22 of the element 10 but would do so if the element 10 were formed of brass or the like.

By employing two halves for the die device, split along the diameter 14, it is possible to assemble the die device into a machine in which a strand has already been threaded, the two halves being soldered into a holder 28 and then the holder and halves being sprung apart and assembled over the strand. The holder is preformed of resilient metal and after being spread has adequate resilience to return the die halves into engagement about the strand. This method of assembling avoids the tedious problem of cutting and splicing the strand as would be required if the die device were in a single piece.

While there have been described above the principles of this invention in connection with specific apparatus, it is to be clearly understood that this description is made only by way of example and not as a limitation to the scope of the invention.

What is claimed is:

1. An application device for use in coating a strand comprising a die assembly of two elements having contiguous flat surfaces which are securely laminated together, said die assembly having a bore through both elements which is of essentially uniform diameter through one of said elements and tapered through the other of said elements; said one element being of polycrystalline synthetic diamond material and said other element being carbide, the other surface of said one element being flat, said assembly being in two halves abuttingly engaged along a plane which diametrally divides said bore.

2. The applicating device of claim 1 wherein the tapered portion of said bore is smoothly radiused where it joins the uniform portion thereof.

3. The applicating device of claim 2 wherein the uniform portion of said bore has a smooth surface.

4. The applicating device of claim 1 wherein said die assembly is disc-shaped having flat outer surfaces which are parallel to each other and to said contiguous flat surfaces.

* * * * *

UNITED STATES PATENT AND TRADEMARK OFFICE

CERTIFICATE OF CORRECTION

PATENT NO. : 4,426,954

DATED : January 24, 1984

INVENTOR(S) : Ronald E. Keller

It is certified that error appears in the above—identified patent and that said Letters Patent is hereby corrected as shown below:

Column 1, line 24, change "671" to --617--.

Signed and Sealed this

*Thirty-first* Day of *July 1984*

[SEAL]

*Attest:*

GERALD J. MOSSINGHOFF

*Attesting Officer*

*Commissioner of Patents and Trademarks*